US007430827B1

(12) United States Patent
Huber

(10) Patent No.: US 7,430,827 B1
(45) Date of Patent: Oct. 7, 2008

(54) GUN TRIGGER

(76) Inventor: John F. Huber, 514 Thorp St., Fond du Lac, WI (US) 54935

( * ) Notice: Subject to any disclaimer, the term of this patent is extended or adjusted under 35 U.S.C. 154(b) by 172 days.

(21) Appl. No.: 11/176,044

(22) Filed: Jul. 7, 2005

Related U.S. Application Data

(63) Continuation of application No. 10/697,847, filed on Oct. 29, 2003, now Pat. No. 7,051,467, which is a continuation-in-part of application No. 10/199,425, filed on Jul. 22, 2002, now Pat. No. 6,681,511.

(51) Int. Cl.
*F41A 19/00* (2006.01)

(52) U.S. Cl. ..... 42/69.01

(58) Field of Classification Search ..... None
See application file for complete search history.

(56) References Cited

U.S. PATENT DOCUMENTS

| | | | | |
|---|---|---|---|---|
| 949,466 | A | 2/1910 | Frommer | |
| 1,297,859 | A * | 3/1919 | Johnson | 42/69.01 |
| 2,249,232 | A | 7/1941 | Smith | |
| 2,388,149 | A | 10/1945 | Humeston | |
| 2,549,904 | A * | 4/1951 | Hoard | 42/69.02 |
| 3,464,399 | A * | 9/1969 | Fisher | 124/37 |
| 3,707,796 | A * | 1/1973 | Bielfeldt | 42/70.05 |
| 3,984,934 | A | 10/1976 | Weiss | |
| 4,315,377 | A | 2/1982 | Jenkins | |
| 4,391,057 | A | 7/1983 | Bornancini | |
| 4,505,182 | A | 3/1985 | Sullivan | |
| 4,667,429 | A * | 5/1987 | Perazzi | 42/69.01 |
| 4,908,970 | A | 3/1990 | Bell | |
| 5,170,771 | A | 12/1992 | Peck | |
| 5,363,581 | A | 11/1994 | Blenk et al. | |
| 5,400,925 | A | 3/1995 | Simmen | |
| 5,487,233 | A | 1/1996 | Jewell | |
| 6,131,324 | A | 10/2000 | Jewell | |
| 6,460,281 | B1 | 10/2002 | Schaeffer | |

(Continued)

FOREIGN PATENT DOCUMENTS

EP 0534522 A1 3/1993

(Continued)

OTHER PUBLICATIONS

Frank Brownwell, Gunsmith Kinks II. Published by Brownwell & Son, 1983, Montezuma, Iowa. (4 sheets included herewith (Cover sheet, Publisher Information, and pp. 356-359.)).

*Primary Examiner*—Michael J. Carone
*Assistant Examiner*—Stewart T Knox
(74) *Attorney, Agent, or Firm*—Brannen Law Office, LLC

(57) ABSTRACT

The present invention relates to a gun trigger for use with a bolt-action gun. The trigger of the present invention has a finger element with an extension and a catch. The catch has a front strap and a rear strap. One or more openings are between the front and rear straps. One or more braces can be across the one or more openings. The trigger also has a head. A socket is formed in the top of the head, and a ball is received within the socket. The height of the ball relative the bottom of the socket can be adjusted. There is practically no friction between the trigger and a sear. The trigger of the present invention may be made by remanufacturing existing conventional triggers.

15 Claims, 14 Drawing Sheets

U.S. PATENT DOCUMENTS 6,474,011 B1 11/2002 Sato
6,477,802 B2 11/2002 Baer, Sr.
6,772,548 B1 * 8/2004 Power ..... 42/69.03
7,047,685 B2 * 5/2006 Diaz et al. ..... 42/69.02
7,096,618 B2 * 8/2006 McGarry ..... 42/70.02
2005/0183311 A1 * 8/2005 Diaz et al. ..... 42/69.01

FOREIGN PATENT DOCUMENTS

FR 2619440 A1 2/1989

* cited by examiner

GUN TRIGGER

This application is a Continuation application of application having Ser. No. 10/697,847, filed Oct. 29, 2003, now U.S. Pat. No. 7,051,467 which was a Continuation-In-Part application of application having Ser. No. 10/199,425, filed Jul. 22, 2002, now U.S. patent having U.S. Pat. No. 6,681,511, the complete disclosures of both are hereby incorporated herein by reference.

FIELD OF THE INVENTION

The present invention relates to a gun trigger that reduces friction between the trigger and the sear or receiver of a gun. The trigger can have a front strap and a rear strap, and also is capable of setting trigger travel. The trigger can be a one-to-one replacement for a conventional trigger.

BACKGROUND

Military personnel and civilians alike desire accurate, yet simple and durable, firearms. One preferred type of firearm is a bolt-action rifle. Generally, a bolt-action rifle has a longitudinal axis. A barrel is in longitudinal alignment with a bolt. A cocking piece with a downwardly extending contact is at the rear end of the bolt. The bolt and cocking piece are within a receiver. The receiver has a bottom. One type of bolt-action rifle is a Mauser type rifle. In a Mauser or similar type rifle, the front of a sear is pivotally connected to the receiver. The rear of the sear has an upwardly extending sear contact. A trigger is pivotally connected to the sear. A conventional trigger, such as the one shown in U.S. Pat. No. 2,549,904 to Hoard, has a top with two bumps thereon that engage the receiver bottom. When the trigger is pulled rearward parallel to the longitudinal axis of the rifle, the bumps slide forward against the receiver bottom, and the rear of the sear and the sear contact pivot down from the receiver bottom. The trigger has a break point. Pulling the trigger past its break point fires the rifle. Play in the trigger before the break point is called creep. Play in the trigger after the break point is called over-travel. Together, the creep and over-travel define the total trigger travel.

Another type of bolt-action rifle is a Mosin-Nagant rifle. In a Mosin-Nagant rifle, the trigger is pivotally connected to the receiver. The sear is deflectably connected to the receiver. The trigger has an opening therethrough for receiving the sear. As a user pulls the trigger, the trigger rotates about a point on the receiver and forces the sear to deflect away from the receiver. The rear of the sear has a sear contact for contacting the cocking piece contact.

A rifle generally can be in one of three positions: an un-cocked position, a cocked position, and a fired position. In the un-cocked position, the cocking piece contact is behind and spaced from the sear contact, and the sear contact does not restrict the cocking piece movement. In the cocked position, the sear contact abuts the cocking piece contact to prevent the cocking piece from moving forward. In the fired position, the cocking piece contact is forward of and out of contact with the sear contact. When the rifle is in the cocked position, pulling the trigger past its break point causes the rifle to fire.

One problem with conventional triggers such as those shown in the Hoard patent is that a relatively large amount of sliding friction exists between bumps on the trigger and the receiver bottom. A patent showing just one bump but still having a similar amount of friction is U.S. Pat. No. 2,388,149 to Humeston. This friction contributes to a large trigger pull. Typically, four to five pounds of force, or more, need to be applied to the trigger in the direction parallel to the longitudinal axis of the gun to fire a gun. Yet, if the shooter fails to pull the trigger straight back, the shooter applies a transverse force to the trigger. A transverse force creates a torque in a direction perpendicular to the longitudinal axis of the gun, which can cause the gun to twist about that axis. The larger the trigger pull, the greater the potential for this type of problem. This problem is prevalent in both Mauser type and Mosin-Nagant type rifles, wherein there exists a large amount of friction between the trigger and the sear.

Further, with respect to the Mauser type rifles, the bumps on the trigger and the receiver bottom can wear away over time. This can cause permanent damage to both the trigger and the receiver bottom.

One publication entitled *Gunsmith Kinks II*, compiled by Frank Brownwell, and published by Brownwell & Son in 1983 shows a ball used in conjunction with a trigger for use with a Mauser type rifle. The ball is not secured in place within the trigger. Further, the sear must be retrofitted to receive the ball. Retrofitting the sear to receive the ball is an undesirable expense. Still further, the location of the ball relative to the trigger is not adjustable. As such, the trigger must be produced within a relatively exact tolerance in order for the gun to function properly. Even if the trigger is made to a relatively exact tolerance, each gun may be made to a less exact tolerance. It may be difficult to mass-produce a non-adjustable trigger. Additionally, gun owners may desire a fine-tuned gun trigger. Yet, the trigger shown in this publication is incapable of being fine-tuned. Hence, users may not find the trigger shown in this publication desirable. A further drawback is that the teachings shown in this publication do not appear to be adaptable to other types of firearms.

A further problem with conventional triggers is that they have a large trigger travel. This problem is prevalent in both Mauser and Mosin-Nagant type rifles. Shooters may find large trigger travel disruptive, as the shooter's finger must go through a larger distance than necessary to fire the rifle.

The Hoard patent discloses two set screws to limit trigger travel in a Mauser type rifle. However, the set screws do not pass through pieces integral with the trigger. Rather, they pass through attachments that must be welded to the trigger. The production costs are undesirably high, and the welds may fail over time.

Other replacement triggers are complex and may require substantial modifications to the gun prior to installation. Many people would be incapable of installing the triggers themselves. The complex triggers may employ springs or the like, that may fail over time. One such design is shown in U.S. Pat. No. 4,908,970 to Bell. The gun trigger in this patent is not a one-to-one replacement for a conventional trigger.

Traditional methods of manufacturing triggers have undesirable limitations. For example, stamping and molding are undesirable in that they are not precise enough to manufacture relatively detailed triggers. Laser cutting produces too much heat to cut tiny pieces, because the heat can melt the metal or otherwise cause undesirable hardening of the material.

These and similar types problems are not limited to the specific types of bolt-action rifles detailed above. Rather, these problems are prevalent in other types of bolt action rifles as well.

There exists a need for a trigger that solves these and other problems.

SUMMARY OF THE INVENTION

The present invention relates to a gun trigger that increases accuracy by reducing friction between the trigger and receiver bottom or sear, and also sets trigger travel. The trigger is also lightweight and can be a one-to-one replacement for a conventional trigger. By way of illustration, the present invention is described in relation to Mauser type and Mosin-Nagant type bolt-action rifles.

Generally, a bolt-action rifle with a longitudinal axis has a barrel in alignment with a bolt. A cocking piece with a downwardly extending contact is at the rear end of the bolt. The bolt and cocking piece are within a receiver. The receiver has a receiver bottom. In a Mosin-Nagant type rifle, the front of a sear is deflectably connected to the receiver. The rear of the sear has an upwardly extending sear contact. The trigger of the present invention is pivotally connected to the receiver. No alterations are needed to the sear in order to use the trigger of the present invention. When the trigger is pulled rearward, the rear of the sear and the sear contact deflect away from the receiver bottom. The trigger has a break point. Pulling the trigger past the break causes the rifle to fire.

The trigger of the present invention has a finger element with a first and opposed second sides. The finger element has an extension and a catch. According to one aspect of the invention, the catch has a front strap and a rear strap. One or more openings are between the front and rear straps. One or more braces can be across the one or more openings. Further, one or more holes can be formed through each brace. Also, a person's initials or a different design can be between the front and rear straps.

The trigger also has a head having a first side and a second side. Each side has a hole therethrough for receiving a pin to pivotally connect the trigger to the receiver. According to another aspect of the invention, the head has a top. A socket is formed in the top of the head. Specifically, the top of the head has a lower side and the socket is formed in the lower side of the head. The socket has sides and a top. A ball is received within the socket. A hole, located through the head from the top of the socket to the upper side of the head, is threaded to receive an adjusting screw. The location of the ball relative the top of the socket can be adjusted by adjusting the screw. When the trigger is pulled, the ball rolls along the sear. Hence, there is practically no friction between the trigger and the top of the sear. The required trigger pull to fire the rifle is reduced. Additionally, the integrity of both the trigger and the sear is maintained.

One advantage of the present invention is that the trigger can be a one-to-one replacement for a conventional trigger. In this regard, most anyone can replace the trigger simply by removing the conventional trigger and inserting the trigger of the present invention.

A feature of the present invention is that the ball location is adjustable. The triggers can be made to a less exacting tolerance, and still be used with virtually all intended guns. Further, the trigger position can be fine tuned by adjusting the ball location.

A further feature of the present invention is the method in which the trigger is produced. Producing the trigger by an abrasive jet machine is precise, produces little heat, is cost effective and is time efficient. The abrasive jet machine enables creation of intricate openings and corners within the finger element and the formation of thin straps. This precision was heretofore unavailable using traditional methods of trigger production such as metal stamping, molding and laser cutting.

Other advantages, benefits, and features of the present invention will become apparent to those skilled in the art upon reading the detailed description of the invention and studying the drawings.

BRIEF DESCRIPTION OF THE DRAWINGS

FIG. 18 is similar to FIG. 11, but shows a further alternative embodiment of the present invention having a front strap, a rear strap and a hole there between.

DETAILED DESCRIPTION OF THE PREFERRED EMBODIMENTS

Figure 1:
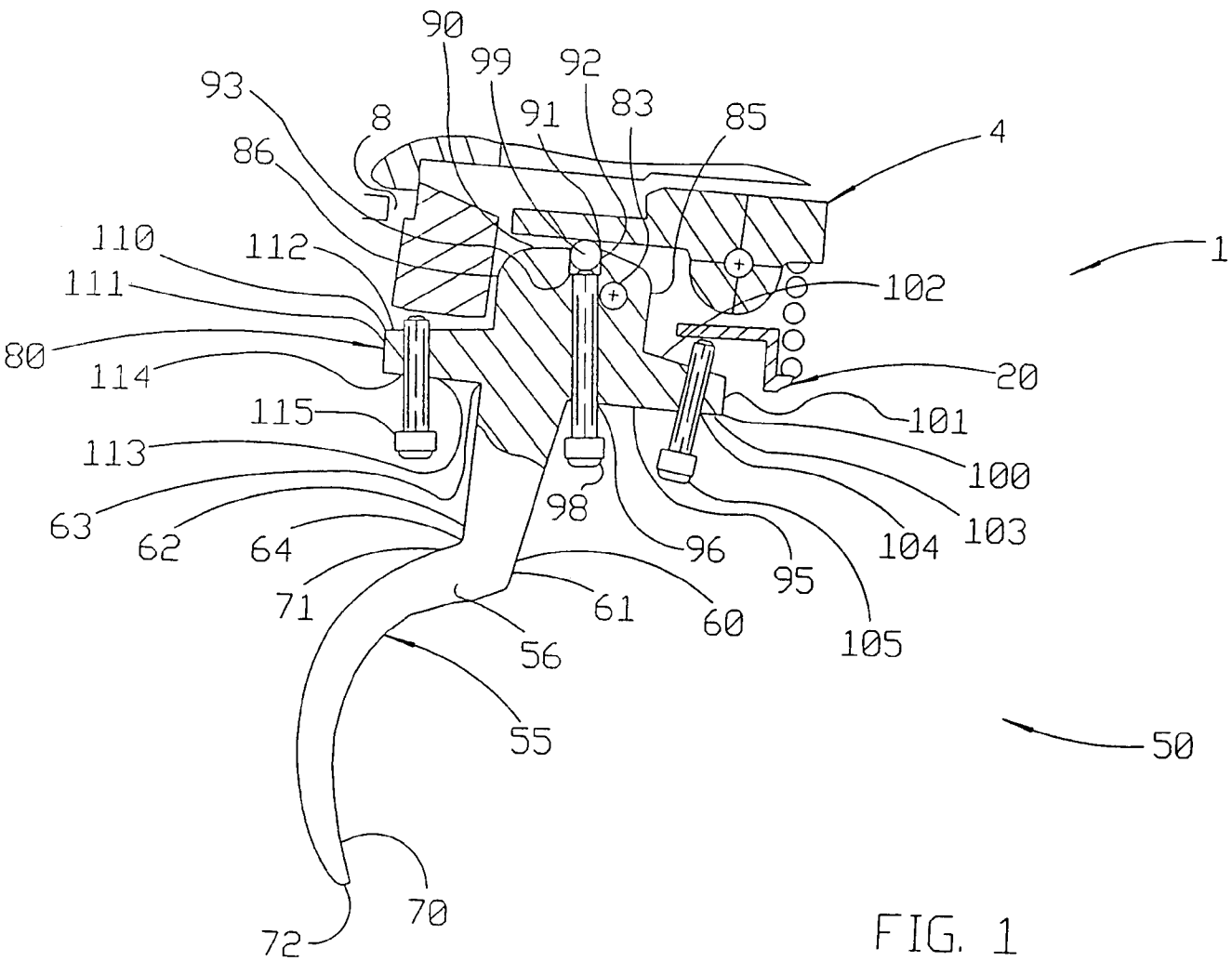
FIG. 1 is a broken, longitudinal, cross-sectional view of the trigger of the present invention.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

Referring first to FIGS. 1-4, reference numeral 50 indicates an embodiment of the anti-friction trigger of the present invention. The trigger 50 is shown and described in connection with a rifle 1. However, it is understood that the present invention can be used with other types of bolt-action guns without departing from the broad aspects of the invention. The rifle 1 has a longitudinal axis 2. Rifle 1 also has a barrel 3 with an inside diameter sufficient to accommodate a bullet. The barrel 3 has a free end from which a bullet projects and an opposite end. A receiver 4 is longitudinally aligned with the barrel 3. The receiver 4 has a receiver bottom 5. The receiver bottom 5 has several openings 8 through it and has a lug 6 extending down from it. A hole 7 is through the lug 6 in a direction perpendicular to the longitudinal axis 2 of the rifle 1. A bolt 9 is located within the receiver 4 and is aligned with the longitudinal axis 2 of the rifle 1.

The bolt 9 has two opposed ends. A spring is within the bolt 9 between the ends. One end of the bolt 9 is near the barrel 3, and a firing pin (not shown) protrudes from that end. The bolt has a lever 11 to enable a user to position the bolt 9 within the receiver 4. A ball or knob is at the free end of the lever 11. A cocking piece 12 is at the end of the bolt 9 opposite the barrel 3. The cocking piece 12 has a bottom with a cocking piece contact 13 extending down therefrom. The cocking piece contact 13 is in a plane perpendicular to the rifle's longitudinal axis 2.

A sear 20 of conventional nature has a front 21 and a rear 22. A sear contact 23 upstands from the rear 22. The sear 20 has a first side wall 25. An ear 26 having an ear hole 27 therethrough is on the first side wall 25. A trigger hole 28 is through the first side 25 between the ear 26 and rear 22. A second side wall 30 is opposite the first side wall 25, and also has an ear 31 with an ear hole 32 therethrough. A trigger hole 33 is through the second side wall 30. The trigger holes 28 and 33 are also aligned. The sear 20 further has a bottom 35 with an opening 36 therethrough and a well 37 near the front 21. A spring 38 is within the well 37. The ears 26 and 31 straddle the lug 6 extending down from the receiver 4. A pin 41 pivotally connects the sear 20 to the lug 6 of the receiver 4. The spring 38 biases the rear 22 of the sear 20 towards the receiver bottom 5 such that the sear contact 23 extends up through an opening 8 in the receiver bottom 5 and is in position to engage the cocking piece contact 13. A stock (not shown) is connected to the receiver bottom 5. A trigger guard (not shown) is connected to the stock.

In accordance with the present invention, the trigger 50 is provided, and is shown in FIGS. 1-7 and 10. The trigger 50 is preferably made of stainless steel. However, other metals, plastics or other materials could alternatively be used without departing from the broad aspects of the invention. In one preferred embodiment, the trigger 50 is made to replace the conventional trigger for a Mauser M48 with a 8 mm barrel. However, by simply varying the dimensions, the trigger 50 can be used with a variety of other bolt-action guns. Examples of other guns in which the principles of the present invention can be used are Springfield 1903 A-3, Arisaka T38/T99 and Enfield P-1914/17 rifles.

The trigger 50 has a finger element 55. The finger element 55 has a first side 56 and a second side 57. The finger element 55 is comprised of an extension 60 and a catch 70, which are preferably integral with each other. The extension 60 has a front 61, rear 62, top 63 and bottom 64. The catch 70 has a top 71 and a bottom 72. The catch 70 is preferably generally C-shaped so that a shooter's finger can comfortably engage it. The catch 70 could have a different shape, such as linear, without departing from the broad aspects of the invention. The finger element can alternatively comprise only a single elongated catch.

Figure 6:
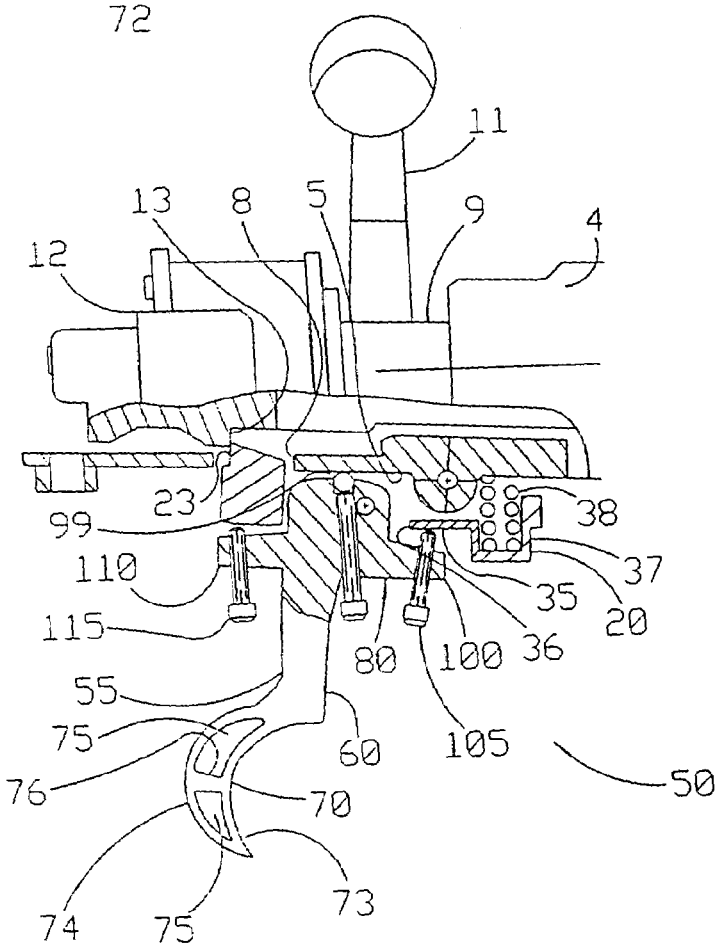
FIG. 6 is a view similar to FIG. 1, but showing an alternative embodiment of the invention.
Figure 10:
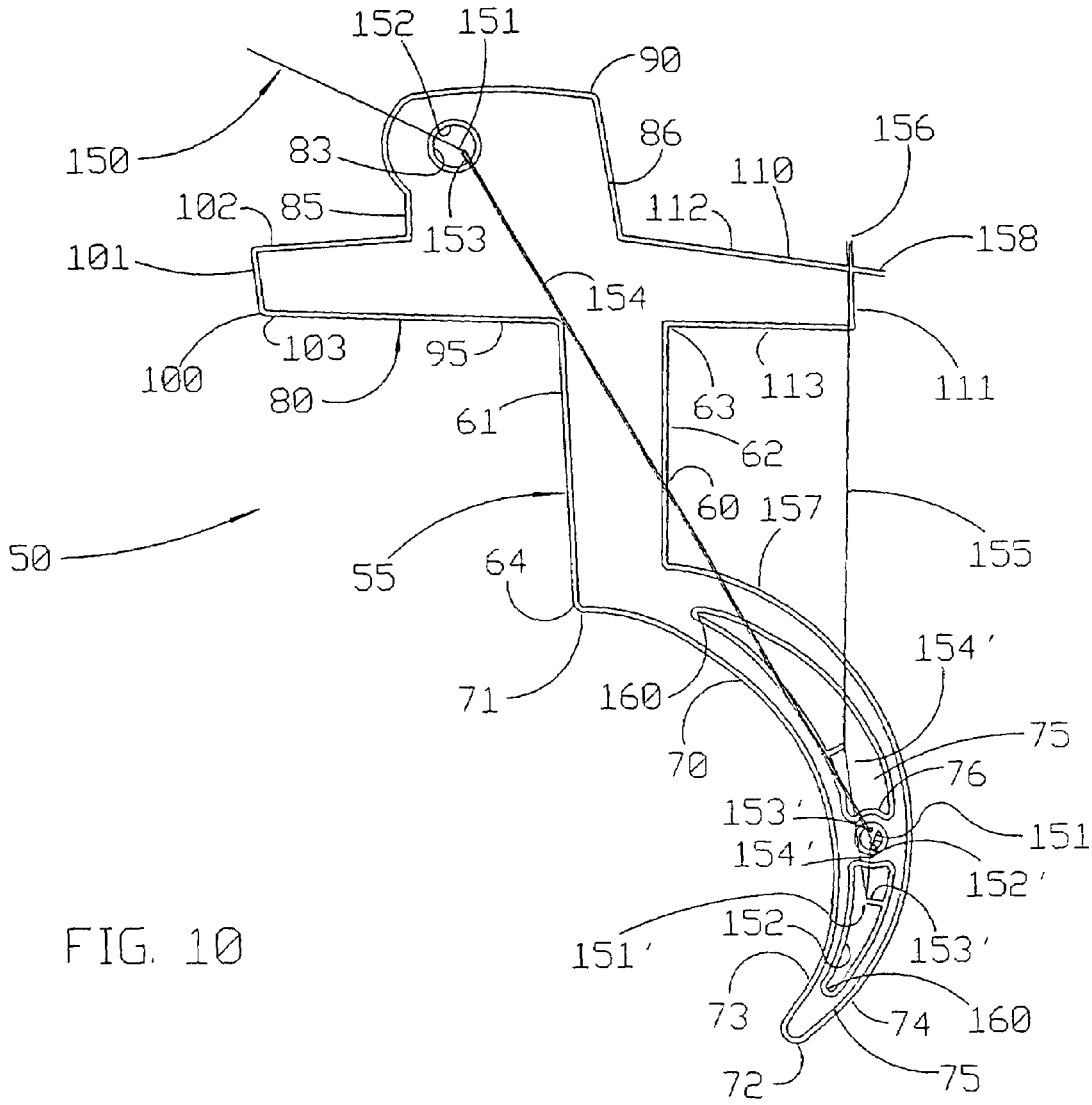
FIG. 10 is a schematic diagram a typical path that an abrasive jet follows to cut an embodiment of the present invention from a plate of material.

In accordance with one of the illustrated embodiments, shown in FIG. 6, the catch 70 has a front strap 73 and a rear strap 74. Two openings 75 are present between the straps 73 and 74. A brace 76 is across the openings 75 between the front and rear straps 73 and 74. The brace 76, front strap 73 and rear strap 74 are preferably integral with each other. The catch 70 can have more than one brace 76 without departing from the broad aspects of the invention. Also, a hole can be formed through the brace 76, as shown in FIG. 10. The shooter's finger engages the front strap 73. The straps 73 and 74 can be very thin, and can have a thickness of as little as approximately 0.03 inches.

Figure 7:
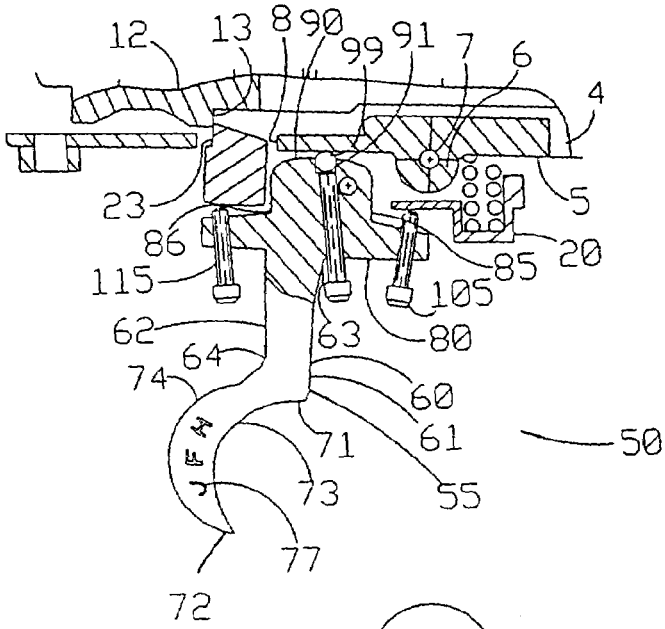
FIG. 7 is a view similar to FIG. 6, but showing an alternative embodiment of the invention.

In accordance with another embodiment, shown in FIG. 7, the catch 70 has initials or other letters 77 formed therethrough. It is contemplated that several other designs and patterns can be formed without departing from the broad aspects of the invention. For example, a gem or stone (not show) could be mounted to an opening 75 between the front and rear straps 73 and 74.

The trigger 50 also comprises a head 80. The head 80 has a first side 81 and a second side 82. The sides 81 and 82 define the width of the head 80. The first side 81 may be coplanar with the first side 56 of the finger element. The head second side 82 may be coplanar with the second side 57 of the finger element. A pivot hole 83 is between the first and second sides 81 and 82. The head 80 has a front 85 and an opposed rear 86.

In accordance with one aspect of the present invention, the head 80 has a top 90 with a socket 91 formed therein near the rear 86 of the head 80. The socket 91 has a circular cross-section with a vertical side surface 92 and a bottom 93. The head 80 further has a bottom 95, shown in FIG. 10. The head 80 defines a hole 96 extending between the bottom 95 of the head 80 and the bottom 93 of the socket 91. The hole 96 has a threaded surface to adjustably receive an adjusting screw 98. The screw 98 has a top and a bottom. A person can grip the bottom of the screw 98 either with his or her fingers, or with a tool. The person can twist the screw 98 within the hole 96 to move the screw up or down. A ball 99 is received within and substantially surrounded by the socket 91. The ball 99 is preferably lubricated. The top of the screw 98 can extend into the socket 91 and contact the ball 99. Hence, the location of the ball 99 relative to the bottom 93 of the socket 91 is adjustable.

In keeping with the invention, a forward lug 100 is provided having a front end 101, a top 102 and a bottom 103. A hole 104 is formed between the top 102 and bottom 103 of the forward lug 100. The hole 104 is threaded to adjustably receive a screw 105. Likewise, a rearward lug 110 is provided having a rear end 111, a top 112 and a bottom 113. A hole 114 is between the top 112 and bottom 113. The hole 114 is threaded to adjustably receive a screw 115. The lugs 100 and 110 are integral with the head 80. However, it is understood that the trigger 50 of the present invention can be made without lugs 100 and 110 without departing from the broad aspects of the invention.

Having described several preferred embodiments of the anti-friction trigger 50, the operation of the trigger 50 in conjunction with a rifle 1, such as a Mauser, will now be described.

The head 80 fits through the opening 36 in the sear 20. The pivot hole 83 is aligned with the trigger holes 28 and 33 of the sear. A pin 40 is inserted through these holes to pivotally connect the trigger 50 to the sear 20. In this regard, the trigger 50 of the present invention is connected to the sear 20 in the conventional manner.

Figures 2, 3, 4:
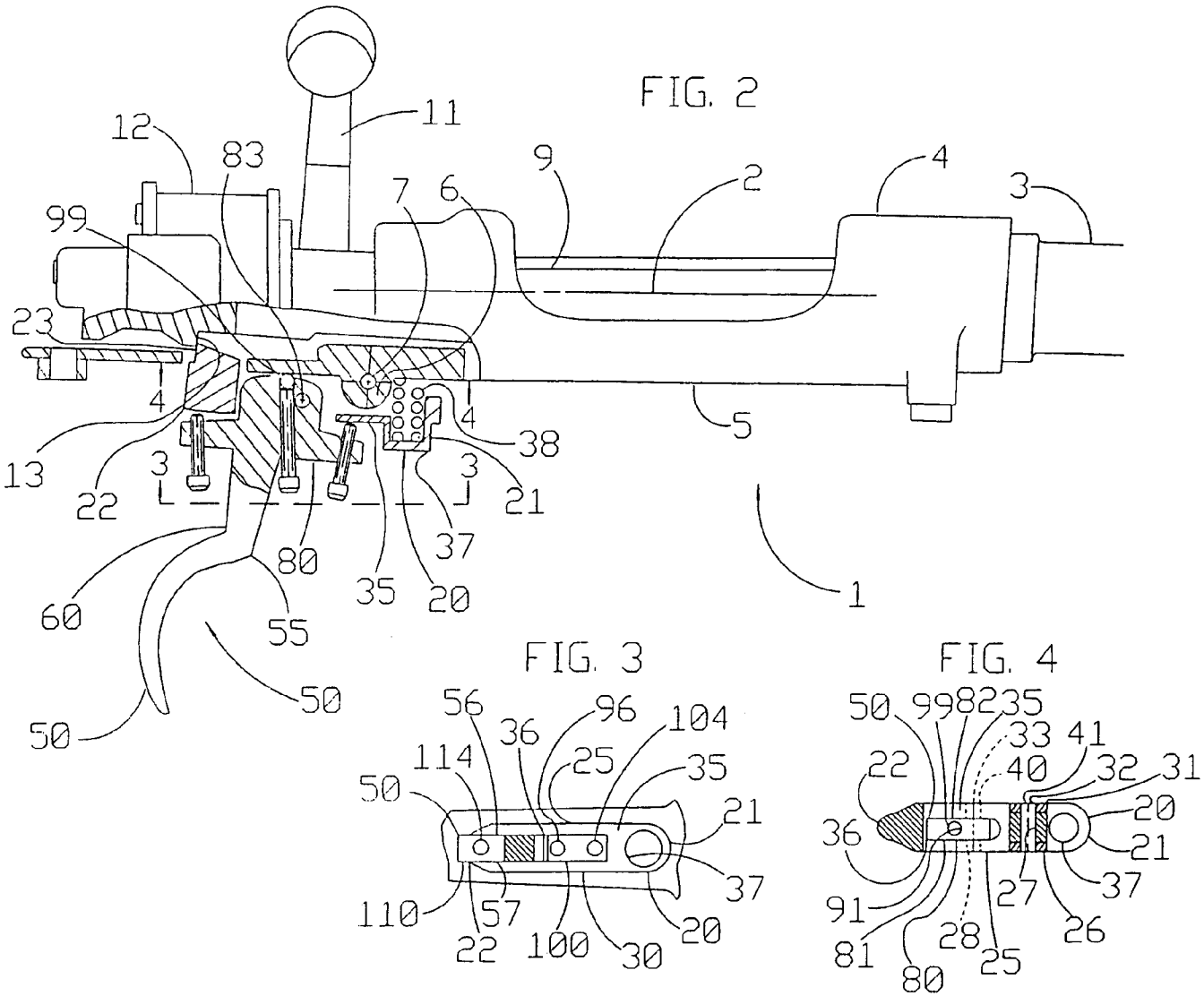
FIG. 2 is a broken, longitudinal, cross-sectional view of the trigger of the present invention showing a gun in a cocked position.
FIG. 3 is a cross-sectional view taken along line 3-3 of FIG. 2.
FIG. 4 is a cross-sectional view taken along line 4-4 of FIG. 2.

The rifle 1 has three positions: an uncocked position, a cocked position, and a fired position. The user loads a bullet into the barrel 3 when the rifle 1 is in the uncocked position. In this position, the sear contact 23 does not engage and is in front of the cocking piece contact 13. The user cocks the rifle 1 by using the lever 11 to manipulate the bolt 9. The sear contact 23 prevents forward movement of the cocking piece contact 13 and the spring within the bolt 9 is stretched. The cocked position is shown in FIGS. 1-2.

Figure 5:
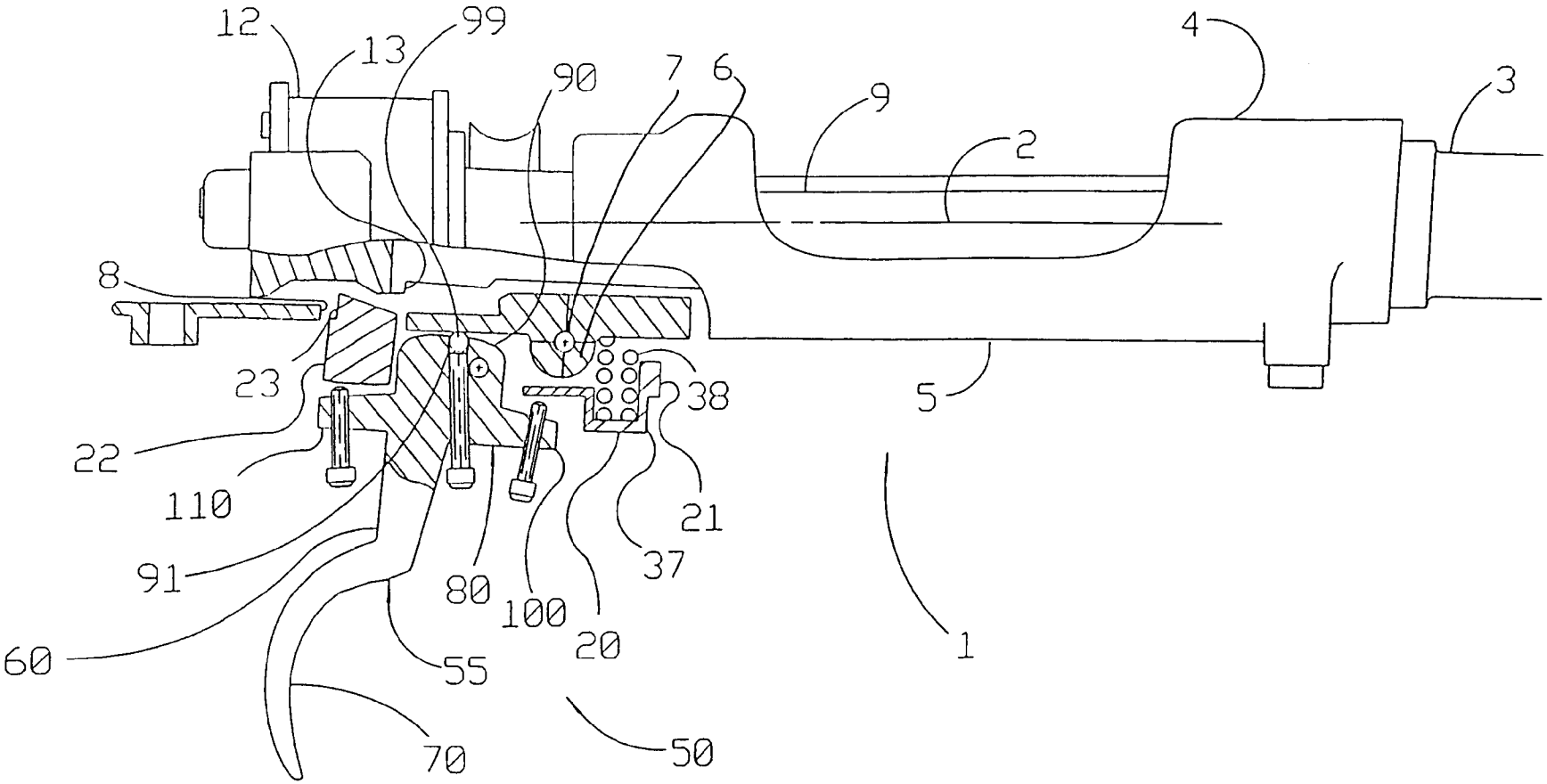
FIG. 5 is a view similar to FIG. 2, but showing the gun in a fired position.

Pulling the trigger 50 rearward causes the sear 20 to pivot relative the trigger 50. The sear 20 also pivots relative the receiver bottom 5, such that the rear 22 of the sear can drop relative the receiver bottom 5. At the trigger break point, the sear contact 23 is at a point where, if the trigger 50 is pulled any farther, the sear 20 will cease to engage the cocking piece contact 13. When the shooter pulls the trigger 50 past its break point, the rifle 1 fires. The mechanics of firing a rifle 1 are well known in the art. Generally speaking, the sear contact 23 stops engaging the cocking piece contact 13, which allows the spring within the bolt 9 to retract and pull the cocking piece 12 forward. The firing pin protrudes from the end of the bolt 9 nearest the barrel 3. In the fired position, the cocking piece contact 13 is forward of the sear contact 23, as shown in FIG. 5. The distance that the trigger 50 travels before the break point is called creep. The distance that the trigger 50 travels after the break point is called over-travel. The combination of creep and over-travel is trigger travel.

The ball 99 is in rolling contact with the receiver bottom 5. The location of the ball 99 within the socket 91 is adjustable. The screw 98 within screw hole 96 can be adjusted to raise or lower the ball 99 within the socket 91. In this regard, the trigger 50 is compatible with guns manufactured to less exact tolerances. The ball 99 rolls along the receiver bottom 5 to eliminate friction between the trigger 50 and the receiver 4. The trigger pull is constant, approximately 27 ounces, up to the break point. After the break point, trigger pull is near 0 ounces.

The screw 105 received in the hole 104 of the forward lug is used to adjust creep. Creep is set when the top of the screw 105 contacts the sear 20. The user simply adjusts the screw 105 to adjust the creep. Raising screw 105 within hole 104 reduces creep. Likewise, the screw 115 in the hole 114 of the rearward lug is used to adjust over-travel. Over-travel is set when the top of the screw 115 contacts the sear 20. Raising screw 115 within hole 114 reduces over-travel. In this regard, the trigger 50 is easily adjustable to suit the user's preferences.

Lugs 100 and 110 are present in preferred embodiment of the present invention. In an embodiment (not shown) where the lugs 100 and 110 are not present, the trigger 50 is a direct one-to-one replacement for the conventional trigger. That is, no modifications at all are required to the gun. When the lugs 100 and 110 are present, a small amount of wood may need to be removed from the stock in order to accommodate the lugs 100 and 110. However, no alterations to the sear 20 or receiver 4 are needed.

Further in accordance with the present invention, the trigger 50 is made with an abrasive jet machine 130. One machine found suitable is made by OMAX Corporation, of Kent, Wash., and has model number 55100 Jetmachining Center.

Figure 8:
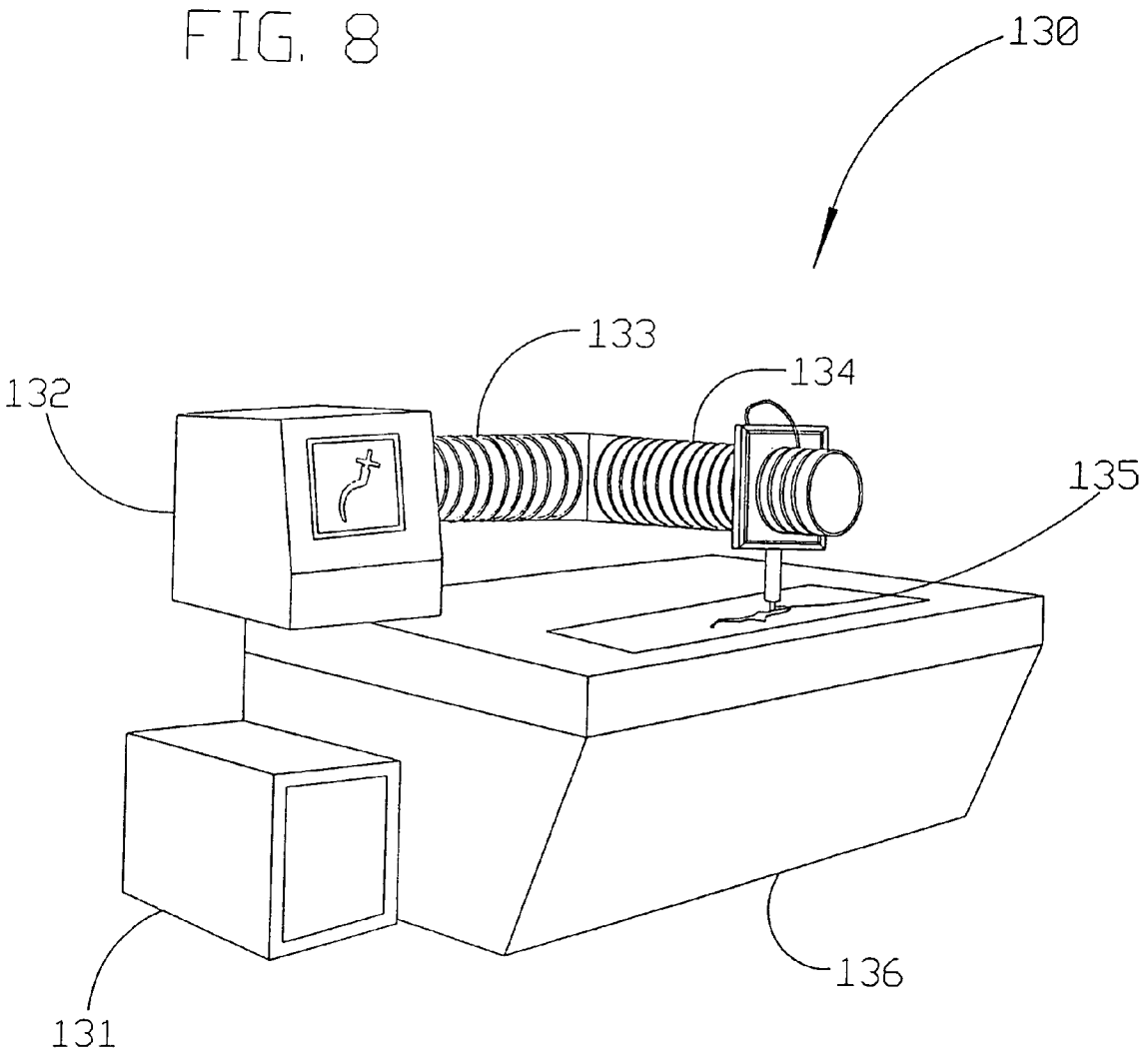
FIG. 8 is a schematic view of a stainless steel plate in position to be cut with an abrasive jet machine.
Figure 9:
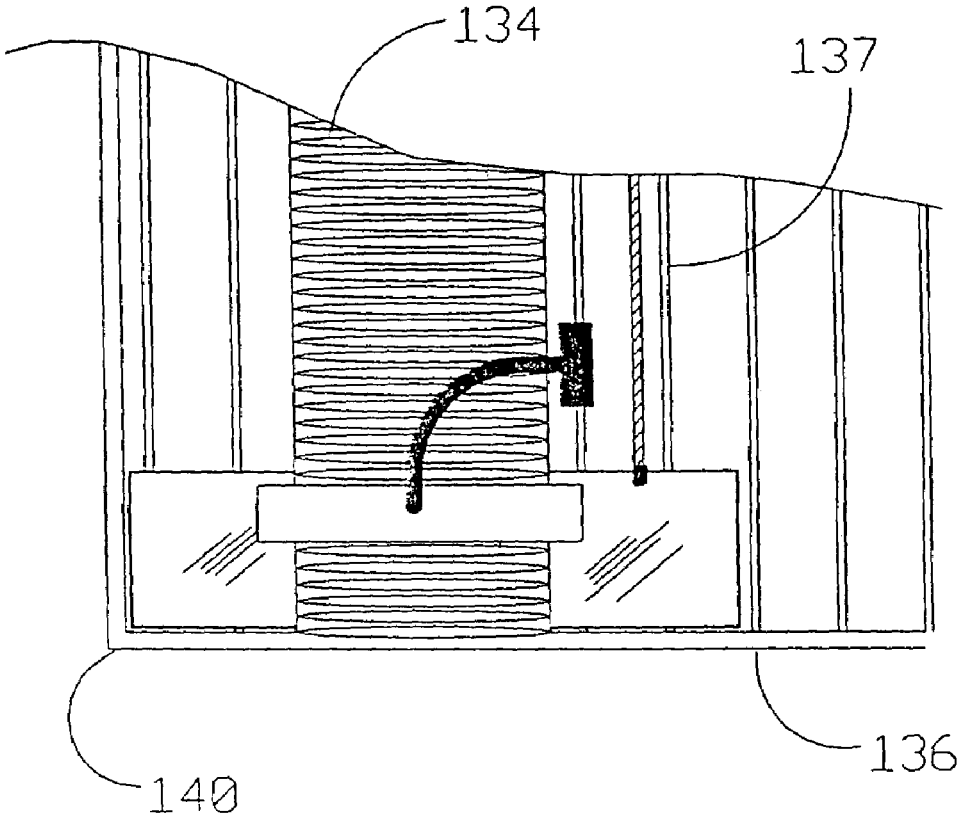
FIG. 9 is an overhead view of FIG. 8.

The abrasive jet machine 130 is shown in FIGS. 8 and 9. The abrasive jet machine 130 has a pump 131 to pressurize water. A computer 132 controls abrasive jet machine 130. The abrasive jet machine 130 operates in two directions. A first arm 133 controls motion in one direction, and a second arm 134 controls motion in a second direction, which is perpendicular with the first direction. The abrasive jet machine 130 has a nozzle 135 that can be energized to discharge water. The nozzle 135 can also be de-energized, in which case the water will bypass the nozzle 135. A ruby jewel (not shown) is in the nozzle 135 and restricts the width of the stream exiting the nozzle 135. An abrasive material is added to the water to abrade materials, such as steel. Garnet is a preferred abrasive. A tank 136 holds discharged water. Several slats 137 are in the tank 136 to hold the item being abraded. A stainless steel plate 140 is held in place on the slats 137, as shown in FIG. 9.

The trigger 50 can optionally be formed from any number of materials. However, the stainless steel plate 140 is a preferred material because it is strong, durable, and shiny. The velocity of the water and abrasive exiting the nozzle can be varied to vary the quality of the cut. The OMAX Corporation abrasive jet has five qualities ranging from quality 1 to quality 5, where 5 represents the best quality. It is preferred to abrade the trigger 50 of the present invention to quality 5.

In the preferred trigger 50 made of stainless steel, the water is compressed to 48,000 P.S.I., and exits the nozzle at a velocity of approximately 3000 feet per second. The preferred width of the opening of the ruby jewel is about 0.014 inches. Water is preferably cleaned before entering the abrasive jet machine to minimize dirt and mineral build up, and to dechlorinate the water to prevent damage to the machine components. Passing the water through a water softener and then through two activated carbon columns has been found acceptable for these purposes.

Water exiting the nozzle at a high rate of speed creates a negative pressure in the end of an abrasive feed tube (not shown), and the garnet is sucked out of the feed tube. To prevent clogging in the feed tube, the feed tube is closed about a second before the nozzle 135 is de-energized. In this way, all abrasive in the feed tube will exit the nozzle 135 and be sucked into the water stream prior to the de-energization of the nozzle 135.

In keeping with the invention, the user can program the coordinates and abrading sequence of a path 150 into the computer 132, or the computer 132 can read the path 150 from an existing file. One typical path 150 is shown in FIG. 10.

First the nozzle 135 is energized and the steel plate 140 is pierced in the center of what will become the head pivot hole 83. A lead-in abrasion 151 is made to the outside of the hole 83 and the perimeter 152 of the hole 83 is abraded in counter-clockwise direction. A lead-out abrasion 153 is then made back towards the center of the hole 83. The nozzle 135 is de-energized and traverses along traverse path 154.

The nozzle 135 is again energized at the middle of what will become a hole through the brace 76. The steel plate 140 is pierced, and a lead-in abrasion 151' is made. The perimeter 152' is then abraded. The jet 130 then makes a lead-out abrasion 153'. Again, the nozzle is de-energized. It then traverses along path 154' to what will become an opening 75 between the front and rear straps 73 and 74. One or more openings 75 between the front and rear straps 73 and 74 are formed in the same manner.

Lastly, the jet traverses along a path 155 to a point beyond the trigger's intended perimeter. The nozzle 135 is energized, the steel is pierced, and a lead-in abrasion 156 is made to the outside periphery of the trigger 50. The periphery 157 is abraded in a clockwise direction. A lead-out abrasion 158 is then made.

The lead-in abrasions 151, 151' and 156 and lead-out abrasions 153, 153' and 158 are preferred to maximize the quality of the trigger surface.

In an alternative embodiment (not shown), the abrasive jet 130 does not make a lead-out abrasion 158 on the perimeter of the trigger 50. Rather, a small tab is left in the periphery 157 so that the trigger 50 remains connected to the plate 140. The trigger 50 can be pried or otherwise removed from the plate 140 at a later time.

Since little heat is produced, the thickness of the front and rear straps 73 and 74 can be produced relatively thin, having a thickness of approximately 0.03 inches. Also, the coordinates can be designed to optimize the amount of triggers 50 that can be cut from a single plate 140. It is preferred that the triggers be laid out at least 1/16 of an inche apart. Intricate openings and corners 160 can be formed using the abrasive water jet 130. Further, the abrasive jet machine 130 can etch a design (not shown) into the surface of the trigger 50.

The time required to make one trigger 50 with the above outlined parameters is approximately 2 minutes for a relatively basic design, and approximately 3½ minutes for a relatively complicated design, such as the one shown in FIG.

10. Generally, the greater the number of holes and intricate corners 160, the greater the time required to produce a trigger 50.

In keeping further with the present invention, the socket 91 and holes 96, 104, and 114 are suitably created by being milled after the perimeter of the trigger has been formed. However, other processes, such as drilling, can be used to create the socket 91 and holes 96, 104, and 114 without departing from the broad aspects of the invention.

Now looking at FIGS. 11-17, further alternative embodiments of the present invention are shown. Reference numeral 250 is used to refer to the trigger as it is shown and described in relation to rifle 201. However, it is understood that rifle 201 is described for illustrative purposes only, and that aspects of trigger 201 can be used in connection with other rifles without departing from the broad aspects of the present invention.

Figure 15:
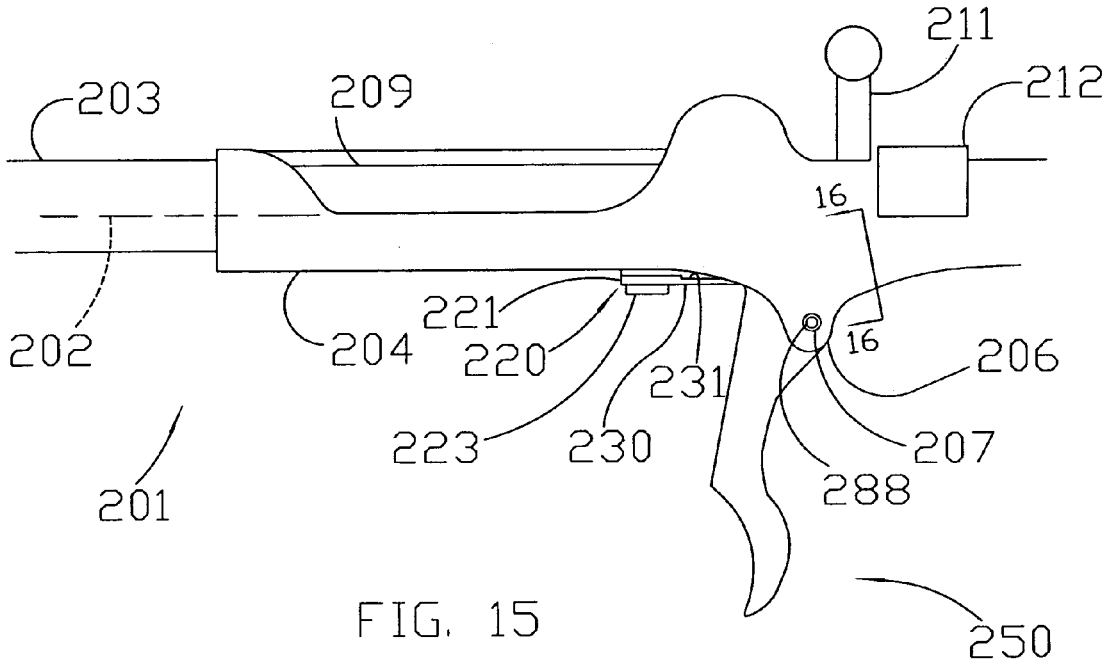
FIG. 15 is a view of the trigger shown in FIG. 11 shown connected to a receiver and relative to a sear.
Figure 17:
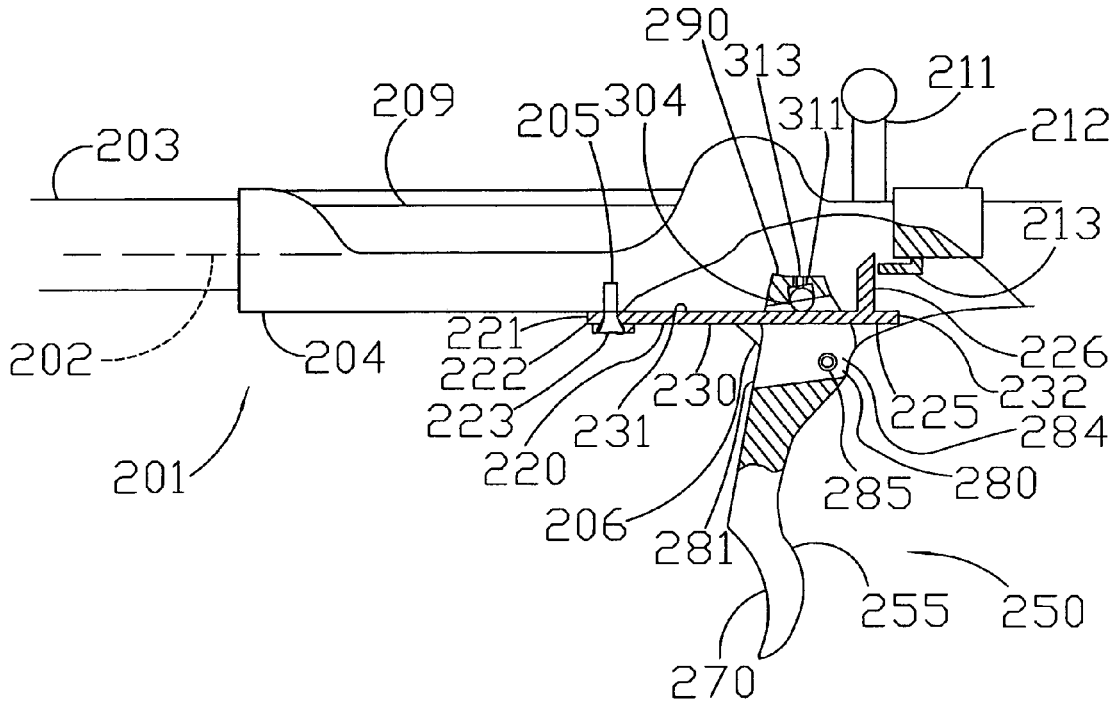
FIG. 17 is similar to FIG. 15, but is a partial cross-sectional view showing the trigger in position relative to a sear and the receiver.

Rifle 201 has a longitudinal axis 202, as shown in FIGS. 15 and 17. Rifle 201 also has a barrel 203 with an inside diameter sufficient to accommodate a bullet. The barrel 203 has a free end from which a bullet projects and an opposite end. A receiver 204 is longitudinally aligned with the barrel 203. The receiver 204 has a receiver bottom. The receiver bottom has a hole 205 therein that is threaded to receive a screw 223, which is discussed below. Two lugs 206 extend below from the bottom of the receiver 204. Each lug 206 has a hole 207 therethrough. The hole 207 through each lug is aligned in a direction that is generally perpendicular to the rifle longitudinal axis 202. An opening 208 is through the bottom of the receiver 204. A bolt 209 is located within the receiver 204 and is aligned with the rifle longitudinal axis 202.

The bolt 209 has two opposed ends. A spring is within the bolt 209 between the ends. One end of the bolt 209 is near the barrel 203, and a firing pin (not shown) can protrude from that end. The bolt 209 has a lever 211 to enable a user to position the bolt 209 within the receiver 204. A ball or knob is at the free end of the lever 211. A cocking piece 212 is at the end of the bolt 209 located away from the barrel 203. The cocking piece 212 has a bottom with a cocking piece contact 213 extending down therefrom. The cocking piece contact 213 is in a plane perpendicular to the rifle longitudinal axis 202.

Figure 16:
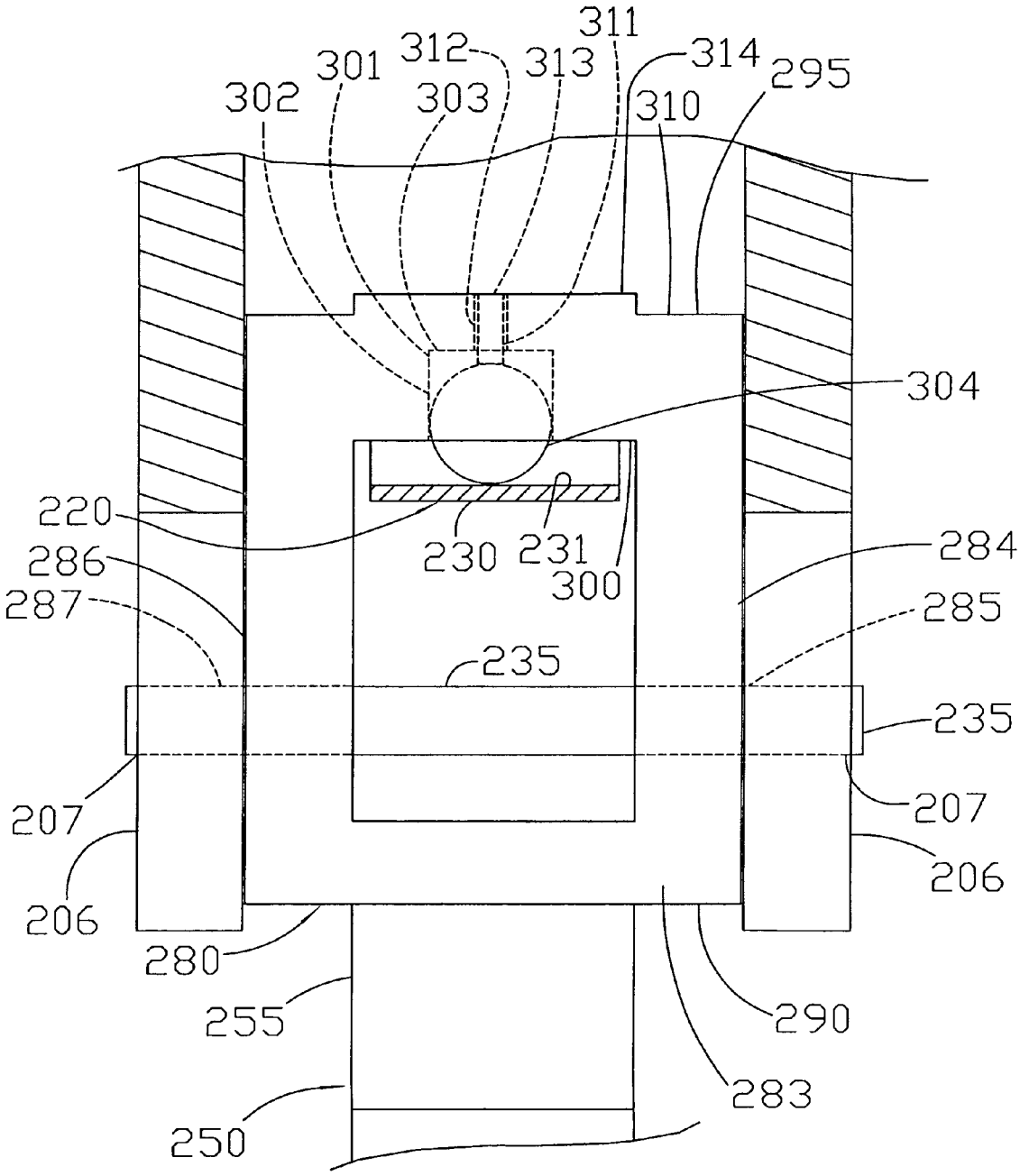
FIG. 16 is a cross-sectional view taken along line 16-16 in FIG. 15.

As shown in FIGS. 15-17, a sear 220 is also provided. The sear 220 is a conventional sear, and has a front 221 and a rear 225. A hole 222 is through the sear 220 near the front 221 of the sear. A screw 223 is provided for being received through hole 222. A sear contact 226 is at the rear of the sear 220. A sear spring 230 is located between the sear front 221 and rear 225. The spring 230 has a top surface 231. A travel stop edge 232 is at the rear 225 of the sear 220 extending behind the sear contact 226.

Hole 222 is alignable with hole 205 in the receiver 204. Screw 223 is receivable into hole 205 to connect the sear 220 to the receiver 204. In this regard, the sear 220 is deflectably connected to the receiver 204. Spring 230 biases the rear 225 of the sear 220 to a first position relative to the receiver 204, where the sear contact 226 is in position to engage and restrain the cocking piece contact 213. Yet, the bias in the spring 230 can be overcome such that the rear 225 of the sear 220 is moved to a second position to allow the cocking piece contact 213 to clear the sear contact 226 in order to fire the rifle 201.

In accordance with a further aspect of the present invention, trigger 250 is provided. Trigger 250 is preferably made of steel. However, other materials such as other metals or plastics may be used without departing from the broad aspects of the present invention. Further, the trigger of the present invention can be coated with a material such as Teflon. Conventional triggers can be remanufactured to make the present invention. Also, the trigger 250 of the present invention can be an originally manufactured item. In a preferred embodiment, trigger 250 is designed for use with Mosin-Nagant type bolt action rifles 201. However, the principles of the present invention can be adapted for use with other types of rifles as well. One example of such a rifle is a SMLE type rifle.

The trigger 250 has a first side 251 and an opposed second side 252. A finger element 255 is provided. The finger element 255 preferably comprises an extension 260 and a catch 270. Extension 260 is preferably integral with catch 270. The extension 260 has a front 261, a rear 262, a top 263 and a bottom 264. The catch has a top 271 and a bottom 272. The catch is preferably generally C-shaped so that a shooter's finger can comfortably engage it. The catch 270 can have a different shape, such a linear, without departing from the broad aspects of the present invention. In an alternative embodiment, the finger element can consist of an elongated catch and not have an extension.

Figure 18:
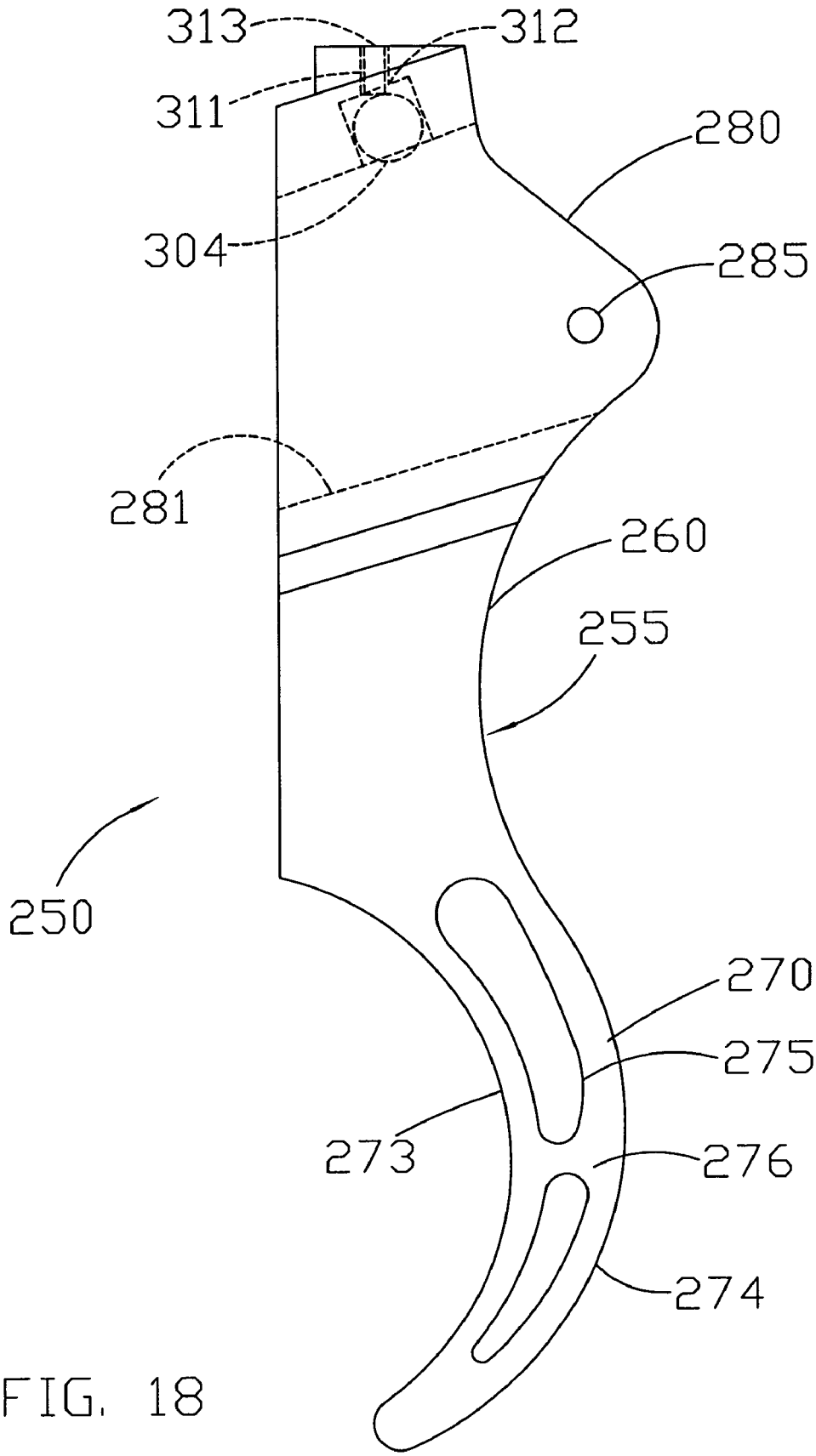

Now looking at FIG. 18, it is shown that the catch 270 can have a front strap 273 and a rear strap 274 with an opening 275 there between. In the illustrated embodiment, a brace 276 is provided between the front strap 273 and rear strap 274. The brace 276, front strap 273 and rear strap 274 are preferably integral with each other. Further, the catch 270 can have more than one brace 276, or even no brace at all, without departing from the broad aspects of the present invention. Still further, the brace 276 can have a hole therethrough. The straps 273 and 274 can preferably have a thickness as small as about 0.03 inches. Similar to trigger 50, initials or other designs can also be formed in trigger 250 without departing from the broad aspects of the present invention.

Figure 11:
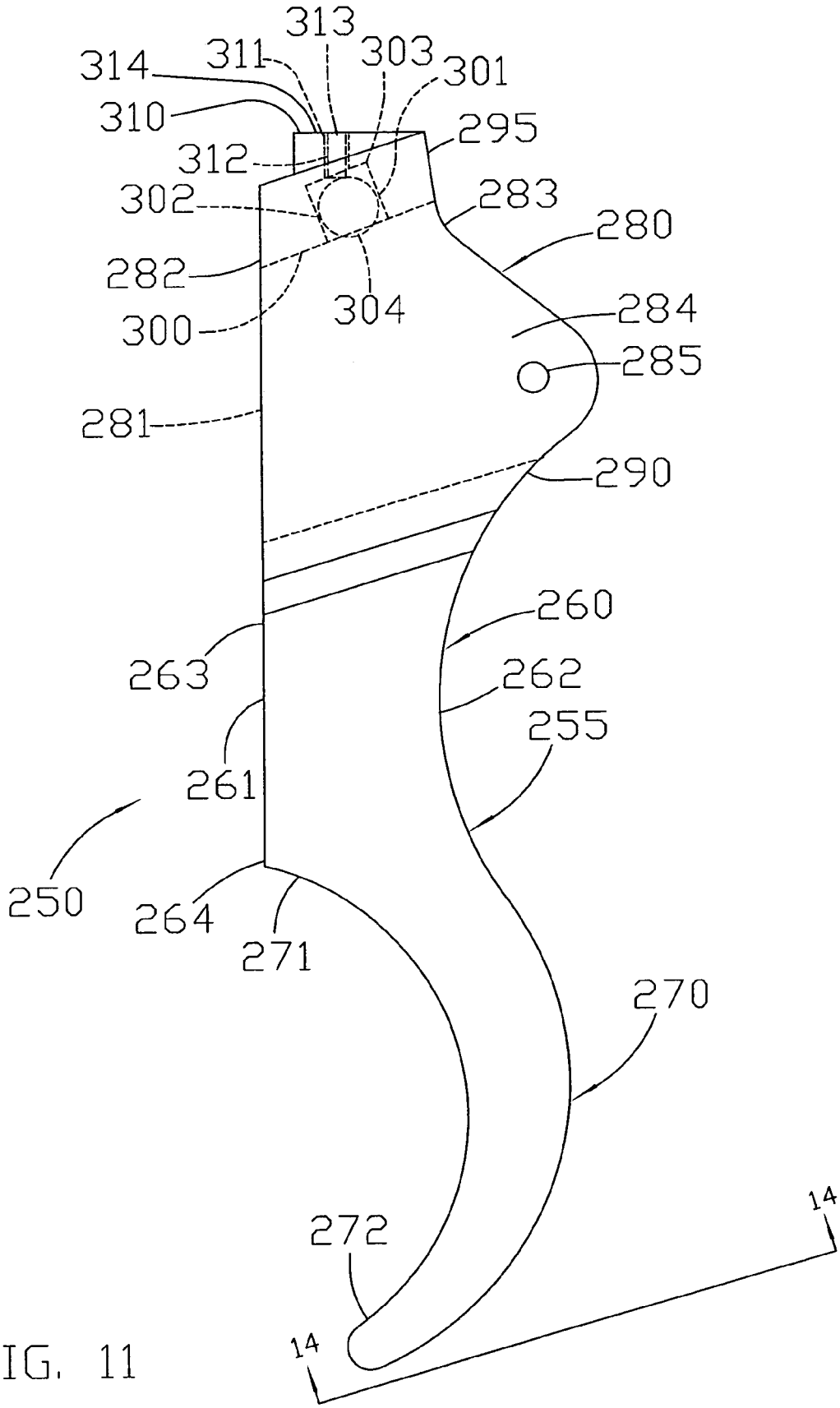
FIG. 11 is a side view of an alternative embodiment of the trigger of the present invention.
Figure 12:
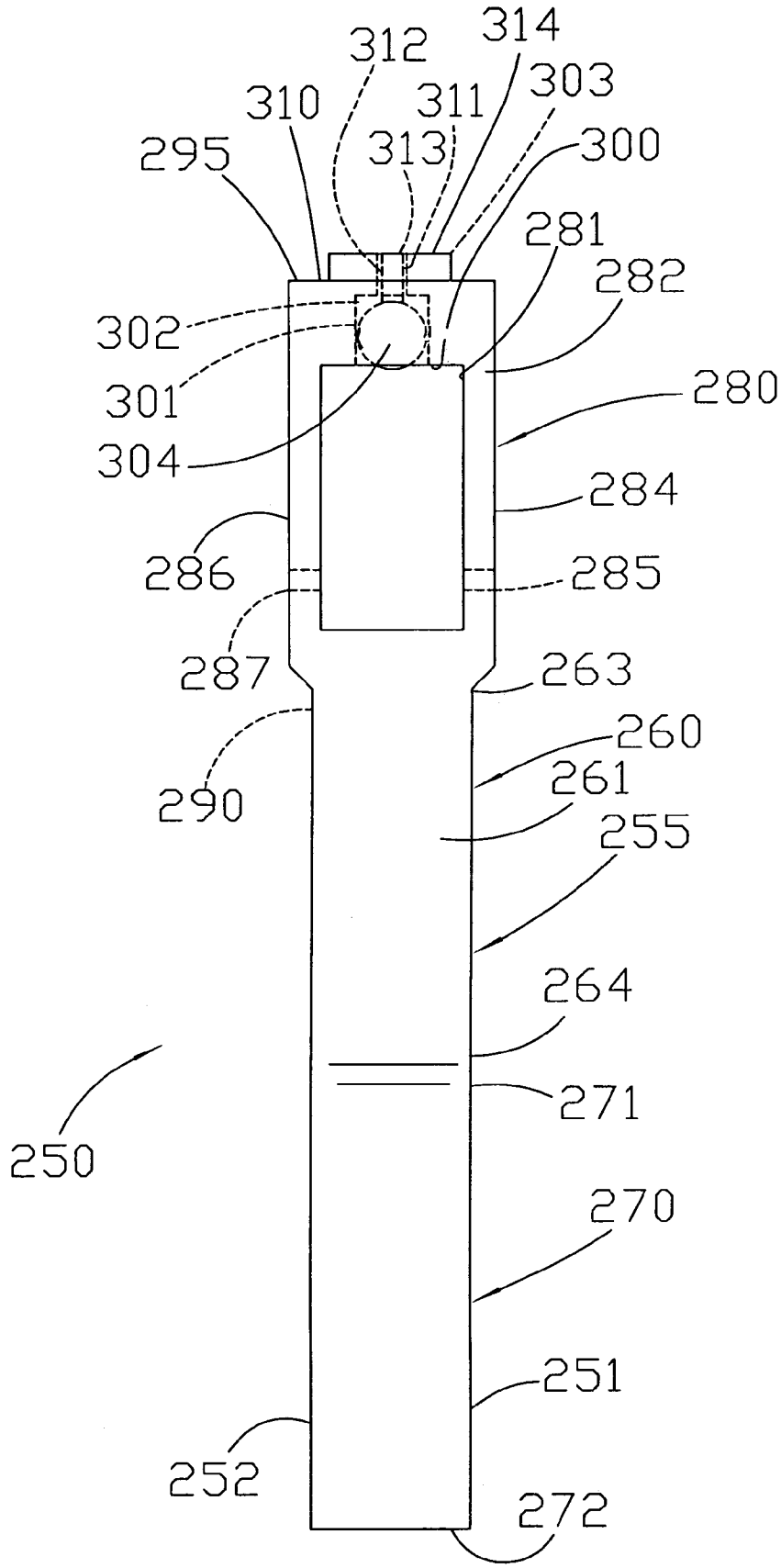
FIG. 12 is a front view of the trigger shown in FIG. 11.
Figure 13:
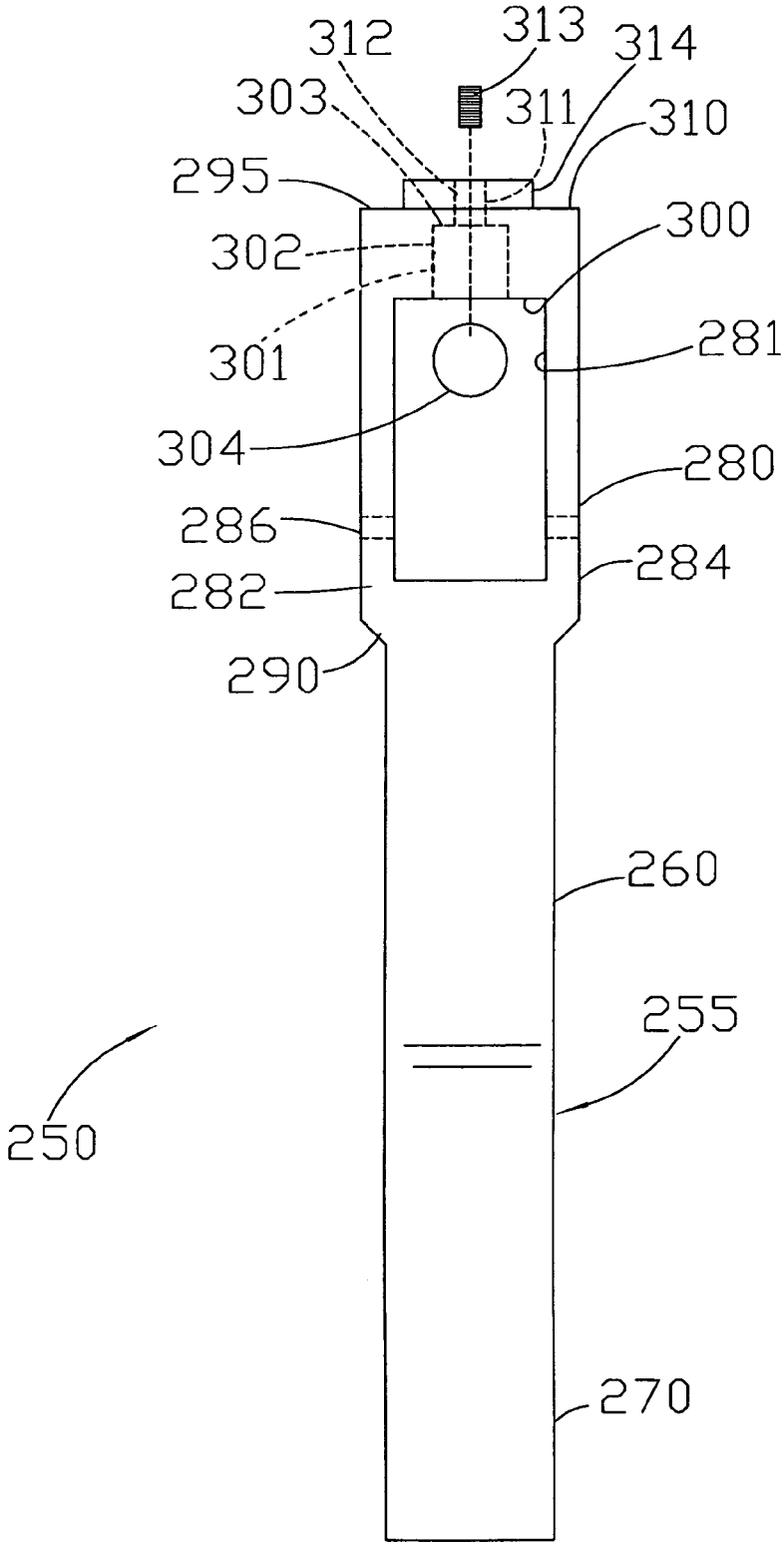
FIG. 13 is an exploded view of the trigger shown in FIG. 12.
Figure 14:
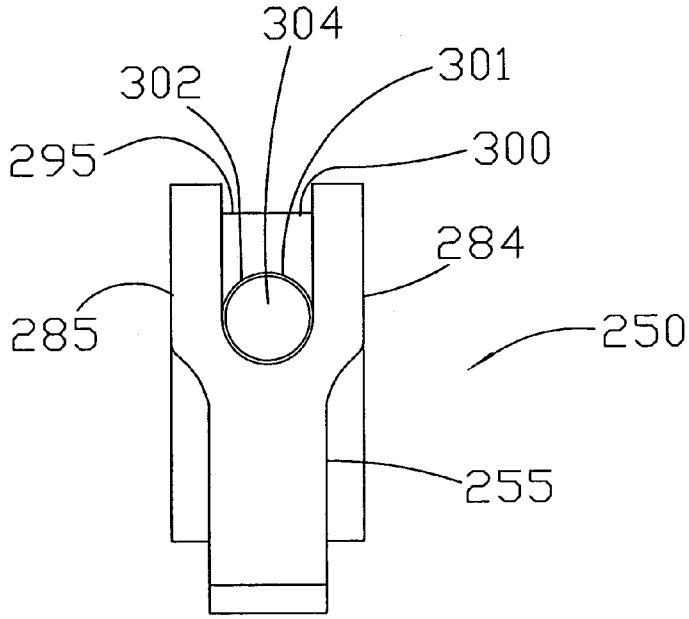
FIG. 14 is a view of the trigger from the perspective of line 14-14 in FIG. 11.

The trigger also comprises a head 280. As best shown in FIG. 11, the head 280 has an opening 281 therethrough extending from the front 282 to the rear 283 of the head. The opening 281 can be a square slot, as best shown in FIGS. 12, 13 and 16. As with conventional triggers, the opening 281 is at an offset angle of approximately 15 degrees from the front 282 of the trigger head 280. The opening 281 is defined by a first side 284, a second side 286 a bottom 290 and a top 295. The first side 284 has a hole 285 therethrough, and the second side 286 has a hole 287 therethrough. Hole 285 is aligned with hole 287. A pin 288 is provided for being received within holes 285 and 287.

The top 295 of the head 280 preferably has a lower side 300 with a socket 301 formed therein. Socket 301 preferably has a generally circular circumference, and has a aside 302 and a top 303. A ball bearing 304 is provided for being received within socket 301. The ball 304 is preferably substantially surrounded by the socket 301, and is preferably lubricated. Grease is one preferred lubricant. In addition to its anti-friction qualities, grease has also been found effective at helping to keep the ball 304 within the socket 301. The top 295 of the head further has an upper surface 310. The head top 295 defines a hole 311 from the socket top 303 to the top upper surface 310. Hole 311 is preferably threaded with threads 312 to receive a screw 313. The screw 313 can be selectably adjusted either further into or out of the hole 311. The upper surface 310 further comprises a bolt stop 314, which is a conventional feature of triggers for use with rifle 201.

The tip of the screw 313 can extend into the socket 301 to contact the ball 304. Hence, it is apparent that the screw 313 can be used to adjust the location of the ball 304 relative to the socket top 303.

It is contemplated that adjusters other than a screw 313 can be used to adjust the location of the ball 304 within the socket 301.

Having now described a preferred structure of an alternative embodiment of trigger 250, the operation of the trigger 250 as used in conjunction with rifle 201 will now be described.

The trigger 250 of the present invention is installed in the conventional manner. To install the trigger, the sear 220 is placed through the opening 281 in the trigger head 280. The trigger 250 is then pivotally connected to the receiver 204 by inserting pin 288 through holes 285 and 287 in the first and second sides 284 and 286, respectively, of the head 280 and through holes 207 in lugs 206 of the receiver 204. Screw 223 is then inserted through hole 222 in the front 221 of the sear 220 and received within hole 205 in the bottom of the receiver 204. In this regard, the sear 220 is deflectably connected to the receiver 204. The finger element 255 is unsupported except for by the trigger head 280.

The rifle 201 has three positions: an un-cocked position, a cocked position, and a fired position. The user loads a bullet into the barrel 203 when the rifle 201 is in an the un-cocked position. In this position, the sear contact 226 does not engage and is in front of the cocking piece contact 213. The user cocks the rifle 201 by using the lever 211 to manipulate the bolt 209 in the conventional manner. The sear contact 226 prevents forward movement of the cocking piece contact 213 and the spring within bolt 209 is stretched.

Pulling the trigger 250 rearward causes the trigger 250 to rotate about pin 288, and cause the portion of the head located in front of pivot hole 285 and 287 to move away from the bottom of the receiver 204. The head 280, and in particular the ball 304 which is located within the socket 301, contacts the sear, as shown in FIGS. 16 and 17. Providing enough pressure to the trigger 250 to overcome the spring bias in the spring 230 of the sear 220 causes the rear 225 of the sear to deflectably drop away from the receiver 204 and causes the sear contact 226 to cease engagement with the cocking piece contact 213. Hence, the rifle 201 fires. When the user releases the trigger 250, the tension in sear spring 230 will return the sear 230 and trigger 250 to their original orientations.

The ball 304 is in rolling contact with the top surface 231 of the sear spring 230. This relationship between the trigger 250 and sear 220 eliminates friction between the trigger 250 and the sear 220. The trigger pull is generally relatively constant up to the break point, and is nearly non-existent after the break point.

The location of the ball 304 within the socket 301 is adjustable. The location of the screw 313 within hole 311 can be adjusted when the trigger 250 is fully installed and the bolt 209 is removed. The screw 313 is twistable to selectably raise or lower the location of the ball 304 relative to the socket top 303. In this regard, the trigger 250 is compatible with guns manufactured to less exact tolerances. Also, the ability to adjust the screw 313 allows the user to eliminate slack or play in the trigger, and also to eliminate a selectable amount of creep. This is accomplished be threading screw 313 into hole 311 to move the ball 304 away from the socket top 303. Slack or looseness in the trigger 250 is eliminated when the ball 304 barely contacts the sear 220 when no pressure is applied to the trigger 250. Creep is selectably reduced by further turning the screw 313 into hole 311 so that the ball 304 starts to force the rear 225 of the sear 220 to deflect away from the receiver 204. Creep can be selectably reduced until the desired interface distance between the sear contact 226 and the cocking piece contact 213 is achieved when the rifle is in the cocked position.

In keeping with the present invention, an originally manufactured conventional trigger can be remanufactured to make the present invention. This is accomplished by relieving some metal from the bottom 290 of the head 280. This is done to make room for the socket 301 to be milled. The trigger 250 can optionally be coated with Teflon.

Thus it is apparent that there has been provided, in accordance with the invention, an anti-friction trigger that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In combination:

a rifle having a sear and a receiver bottom;

a first screw;

a pin; and a trigger for use with said rifle and comprising:

a head made of a selected material and having a first side, a second side, a front, a rear, a top surface and a bottom surface, said first side and said second side defining a first hole there between for receiving said pin, said pin pivotally connecting said trigger to said sear, said head having a second hole formed therein upward from said bottom surface for receiving said first screw;

a balled surface comprised of a ball, wherein said top surface has a socket formed therein for receiving said ball, said ball being in direct contact with said receiver bottom, and a finger element connected to said bottom, wherein said first screw is selectable turned into and out of said second hole a selected amount to adjust the distance between said head and said receiver bottom.

2. In combination:

a rifle having a sear and a receiver bottom;

a first screw;

a pin; and a trigger for use with said rifle and comprising:

a head made of a selected material and having a first side, a second side, a front, a rear, a top surface and a bottom surface, said first side and said second side defining a first hole there between for receiving said pin, said pin pivotally connecting said trigger to said sear, said head having a second hole formed therein upward from said bottom surface for receiving said first screw;

a finger element connected to said bottom; and a ball, wherein:

said top surface has a socket formed therein for receiving and substantially surrounding said ball, said ball being in contact with said receiver bottom; and said first screw has a first end and a second end, said second end of said first screw contacting said ball to selectably move said ball up and down within said socket, and said first screw is selectably turned into and out of said second hole a selected amount to adjust the distance between said head and said receiver bottom.

3. The combination of claim 2 further comprising a second screw and a third screw, wherein said head further comprises:

a forward lug integral with said head and made of said selected material, and having a first lug top and a first lug bottom with a third hole there between to adjustably receive said second screw, said second screw selectably contacting said sear; and a rearward lug integral with said head and made of said selected material, and having a second lug top and a second lug bottom with a fourth hole there between to adjustably receive said third screw, said third screw selectably contacting said sear.

4. The combination of claim 2 wherein said finger element comprises:

a front strap; and a rear strap behind said front strap;

wherein an opening is present between said front strap and said rear strap.

5. The combination of claim 2 wherein said second hole is located between said first hole and said rear.

6. In combination:

a rifle having a sear and a receiver bottom;

a pin;

a first screw; and a trigger for use with said rifle, said trigger comprising:

a head made of a selected material and having a first side, a second side, a front, a rear, a top surface and a bottom surface, said first side and said second side defining a first hole there between for receiving said pin, said pin pivotally connecting the trigger to said sear, said head having a second hole formed therein upward from said bottom surface and located between said first hole and said rear for receiving said first screw;

a balled surface wherein said balled surface is comprised of a ball, wherein said top surface has a socket formed therein for receiving said ball, said ball being in direct contact with said receiver bottom; and a finger element connected to said bottom, wherein said first screw is selectable turned into and out of said second hole a selected amount to adjust the distance between said second hole and said receiver bottom.

7. In combination:

a rifle having a sear and a receiver bottom;

a pin;

a first screw; and a trigger for use with said rifle, said trigger comprising:

a head made of a selected material and having a first side, a second side, a front, a rear, a top surface and a bottom surface, said first side and said second side defining a first hole there between for receiving said pin, said pin pivotally connecting the trigger to said sear, said head having a second hole formed therein upward from said bottom surface and located between said first hole and said rear for receiving said first screw;

a finger element connected to said bottom; and a ball, wherein:

said top surface has a socket formed therein for receiving and substantially surrounding said ball for being in contact with said receiver bottom; and said first screw has a first end and a second end, said second end of said first screw contacting said ball to selectably move said ball up and down within said socket to adjust the distance between said top surface and said receiver bottom, and said first screw is selectable turned into and out of said second hole a selected amount to adjust the distance between said second hole and said receiver bottom.

8. The combination of claim 7 further comprising a second screw and a third screw, wherein said head further comprises:

a forward lug integral with said head and made of said selected material, and having a first lug top and a first lug bottom with a third hole there between to adjustably receive said second screw, said second screw selectably contacting said sear; and a rearward lug integral with said head and made of said selected material, and having a second lug top and a second lug bottom with a fourth hole there between to adjustably receive said third screw, said third screw selectably contacting said sear.

9. The combination of claim 7 wherein said finger element comprises:

a front strap; and a rear strap behind said front strap;

wherein an opening is present between said front strap and said rear strap.

10. In combination:

a rifle having a sear and a receiver bottom;

a pin;

an adjustably located rounded surface comprised of a ball; and a trigger for use with said rifle, said trigger comprising:

a head made of a selected material and having a first side, a second side, a front, a rear, a top surface and a bottom surface, said first side and said second side defining a first hole there between for receiving said pin, said pin pivotally connecting the trigger to said sear, said top being between said front and said rear of said head and having a socket formed therein for receiving said ball, said ball being in direct contact with said receiver bottom; and a finger element connected to said head, wherein said adjustable located rounded surface is selectable adjusted to adjust the distance between said head and said receiver bottom.

11. The combination of claim 10 further comprising a first screw, wherein:

said socket has a socket bottom; and said head defines a second hole between said bottom of said head and said socket bottom for receiving said first screw for adjusting the location of said adjustably located rounded surface relative to said socket bottom to thereby adjust the location of said head relative to said receiver bottom.

12. The combination of claim 11 wherein said second hole is located between said first hole and said rear of said head.

13. The combination of claim 10 further comprising a second screw and a third screw, wherein said head further comprises:

a forward lug integral with said head and made of said selected material, and having a first lug top and a first lug bottom with a third hole there between to adjustably receive said second screw, said second screw selectably contacting said sear; and a rearward lug integral with said head and made of said selected material, and having a second lug top and a second lug bottom with a fourth hole there between to adjustably receive said third screw, said third screw selectably contacting said sear.

14. The combination of claim 10 wherein said finger element comprises:

a front strap; and a rear strap behind said front strap, wherein an opening is present between said front strap and said rear strap.

15. The combination of claim 10 wherein said socket substantially surrounds said adjustably located rounded surface.

* * * * *